US006219921B1

(12) United States Patent
Pettersson

(10) Patent No.: US 6,219,921 B1
(45) Date of Patent: Apr. 24, 2001

(54) CHAIN SAW GUIDE BAR WITH CLEANING MEANS

(75) Inventor: Karl-Olof Pettersson, Voxnabruk (SE)

(73) Assignee: Kapman AB, Sandviken (SE)

( * ) Notice: Subject to any disclaimer, the term of this patent is extended or adjusted under 35 U.S.C. 154(b) by 0 days.

(21) Appl. No.: 09/117,900

(22) PCT Filed: Sep. 4, 1997

(86) PCT No.: PCT/SE97/01483

§ 371 Date: Oct. 19, 1998

§ 102(e) Date: Oct. 19, 1998

(87) PCT Pub. No.: WO98/10905

PCT Pub. Date: Mar. 19, 1998

(30) Foreign Application Priority Data

Sep. 11, 1996 (SE) ..... 9603299

(51) Int. Cl.[7] ..... B27B 17/02
(52) U.S. Cl. ..... 30/123.4; 30/383
(58) Field of Search ..... 30/123.4, 383; 83/168, 169, 171

(56) References Cited

U.S. PATENT DOCUMENTS

| | | | | |
|---|---|---|---|---|
| 3,044,506 | * | 7/1962 | Oehrli | 30/123.4 |
| 5,056,224 | * | 10/1991 | Seigneur | 30/123.4 |
| 5,143,131 | * | 9/1992 | Seigneur et al. | 30/123.4 |
| 5,426,854 | | 6/1995 | Leini et al. | 30/123.4 |
| 5,669,140 | * | 9/1997 | Tsumura | 30/123.4 |
| 5,845,402 | * | 12/1998 | Leini | 30/123.4 |

FOREIGN PATENT DOCUMENTS

| | | |
|---|---|---|
| WO 94/16867 | 8/1994 | (WO) . |
| WO 96/01725 | 1/1996 | (WO) . |

* cited by examiner

*Primary Examiner*—M. Rachuba
(74) *Attorney, Agent, or Firm*—Burns, Doane, Swecker & Mathis, L.L.P.

(57) ABSTRACT

A chain saw guide bar with at least one internal channel for spraying the sawn surface with liquid through nozzles, where the channel is extended in front of the nozzles by an end portion terminated by a closeable cleaning hole with a larger section than the nozzles and usable for cleaning the channel with compressed air or liquid.

5 Claims, 1 Drawing Sheet

CHAIN SAW GUIDE BAR WITH CLEANING MEANS

BACKGROUND

Figure 1:
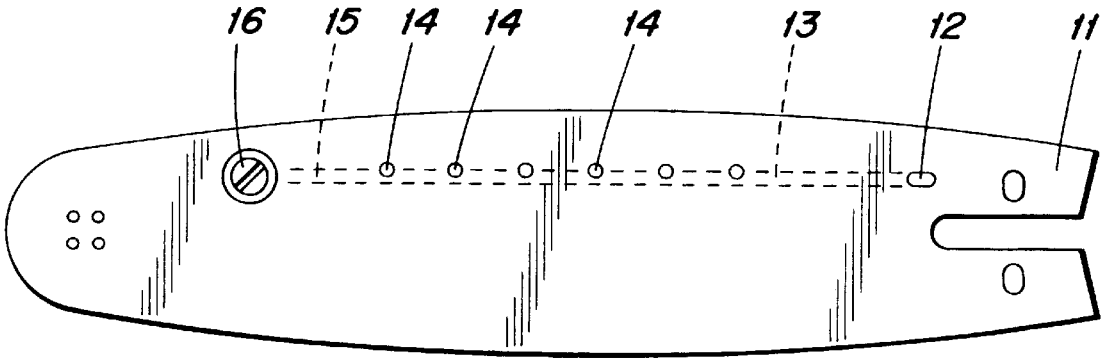

Chain saw guide bars, especially for mounting on tree harvest vehicles, are often provided with internal channels for spraying the sawn surface with liquids such as fungicides, where the channels are made with several small nozzles. The liquid may sometimes contain particles, including dirt or crystals settled during interruptions of the work, or when a guide bar has been dismounted for servicing. The nozzles are so small that they may be clogged by such particles, and there is a need for cleaning the channels, which is very difficult with prior guide bar designs.

According to the invention, the channels can be cleaned by compressed air as part of servicing.

BRIEF DESCRIPTION OF THE DRAWING FIGURE

FIG. 1 shows an exterior view of the guide bar according to the present invention.

DESCRIPTION

A guide bar according to the invention is described with reference to FIG. 1, showing an exterior view. The guide bar has a clamping end (11) with supply holes (12) where liquid is supplied from the power unit. The liquid travels through one or more channels (13) in the guide bar to a multitude of nozzles (14) which may be located at the main channel or at branches to it. The nozzles have basically the same small size and cannot be used to clean the channels by compressed air, since they will not let in enough air to clean the wider channels, and since most of the air would escape through neighbouring nozzles instead of following the channels (13) to the supply holes (12).

According to the invention each channel is extended past the outermost nozzle or branch to an end portion (15). This allows particles to collect in the end portion without forming tough deposits or clogging nozzles. The end portion (15) is terminated with a large closeable cleaning hole (16), which is closed by a plug when in use. The cleaning hole are the plug are preferably threaded. When the guide bar is to be cleaned, the plug is removed and the cleaning hole connected to a compressed air supply, which allows particles and liquid remains to be blown along the channel (13) and out through the supply hole (12). Alternatively, the compressed air supply can be connected to the supply hole and the particles be blown out through the cleaning hole (16). For dried liquid remains, water or other solvents can be used instead of compressed air.

When the channel has been cleaned, the plug is reattached to the cleaning hole (16) and the guide bar can be used again.

What is claimed is:

1. A chain saw guide bar, comprising:

at least one internal channel and a plurality of nozzles connected to the internal channel, for spraying a sawn surface with liquid through the nozzles, wherein the channel is extended in front of the nozzles by an end potion with a closeable cleaning hole, the cleaning hole having a larger cross section than cross sections of the nozzles.

2. The chain saw guide bar according to claim 1, wherein the cleaning hole is closeable with a removable plug.

3. The chain saw guide bar according to claim 2, wherein the cleaning hole and the plug are threaded.

4. A chain saw guide bar, comprising:

a bar having a distal and proximal end;

at least one supply hole for supplying liquid, said at least one supply hole disposed at said proximal end of said bar;

a closeable cleaning hole disposed at said distal end of said bar;

at least one internal channel for spraying the sawn surface with liquid, said channel extending from said at least one supply hole to said closeable cleaning hole;

a plurality of nozzles disposed along said at least one internal channel between said supply hole and said closeable cleaning hole; and an end portion of the one internal channel disposed at said distal end of said bar, said end portion extending from a last of said nozzles to said closeable cleaning hole.

5. The chain saw guide bar of claim 4, wherein said closeable cleaning hole has a larger cross section than cross sections of the nozzles.

* * * * *